US007648560B2

(12) United States Patent
Ogasawara et al.

(10) Patent No.: US 7,648,560 B2
(45) Date of Patent: Jan. 19, 2010

(54) METHOD FOR PRODUCING TI OR TI ALLOY THROUGH REDUCTION BY CA

(75) Inventors: Tadashi Ogasawara, Amagasaki (JP); Makoto Yamaguchi, Amagasaki (JP); Masahiko Hori, Amagasaki (JP); Toru Uenishi, Amagasaki (JP); Katsunori Dakeshita, Amagasaki (JP)

(73) Assignee: Osaka Titanium Technologies Co., Ltd., Hyogo (JP)

( * ) Notice: Subject to any disclaimer, the term of this patent is extended or adjusted under 35 U.S.C. 154(b) by 196 days.

(21) Appl. No.: 10/575,225

(22) PCT Filed: Oct. 6, 2004

(86) PCT No.: PCT/JP2004/014720

§ 371 (c)(1),
(2), (4) Date: Apr. 7, 2006

(87) PCT Pub. No.: WO2005/035805

PCT Pub. Date: Apr. 21, 2005

(65) Prior Publication Data

US 2007/0193411 A1 Aug. 23, 2007

(30) Foreign Application Priority Data

Oct. 10, 2003 (JP) ..... 2003-352661
Oct. 2, 2004 (JP) ..... 2004-033466

(51) Int. Cl.
*C22B 34/12* (2006.01)
*C25C 1/02* (2006.01)

(52) U.S. Cl. ..... 75/617; 75/589; 205/560; 205/620

(58) Field of Classification Search ..... 75/617, 75/619, 620, 589; 205/560, 620
See application file for complete search history.

(56) References Cited

U.S. PATENT DOCUMENTS 2,205,854 A 6/1940 Kroll (Continued)

FOREIGN PATENT DOCUMENTS

JP 60-238429 11/1985

(Continued)

OTHER PUBLICATIONS

Machine translation of JP 2002-129250.*

(Continued)

*Primary Examiner*—George Wyszomierski
*Assistant Examiner*—Tima M McGuthry-Banks
(74) *Attorney, Agent, or Firm*—Clark & Brody

(57) ABSTRACT

The present invention is a method for producing Ti or a Ti alloy through reduction of $TiCl_4$ by Ca, which can produce the high-purity metallic Ti or high-purity Ti alloy. A molten salt containing $CaCl_2$ and having Ca dissolved therein is held in a reactor vessel, and a metallic chloride containing $TiCl_4$ is reacted with Ca in the molten salt to generate Ti particles or Ti alloy particles in a molten $CaCl_2$ solution, which allows enhancement of a feed rate of $TiCl_4$ which is of a raw material of Ti, and also allows a continuous operation. Therefore, the high-purity metallic Ti or the high-purity Ti alloy can economically be produced with high efficiency. Further, the method by the present invention eliminates the need of replenishment of expensive metallic Ca and of the operation for separately handling Ca which is highly reactive and difficult to handle.

12 Claims, 6 Drawing Sheets

U.S. PATENT DOCUMENTS

| | | | | |
|---|---|---|---|---|
| 2,845,386 | A | | 7/1958 | Olson |
| 2,890,112 | A | * | 6/1959 | Winter, Jr. ..... 75/619 |
| 3,043,756 | A | * | 7/1962 | Cobel et. al. ..... 205/402 |
| 4,105,440 | A | | 8/1978 | Gentaz et al. |
| 4,487,677 | A | | 12/1984 | Murphy |
| 4,820,339 | A | * | 4/1989 | Bienvenu et al. ..... 75/368 |
| 2002/0194953 | A1 | | 12/2002 | Rosenberg et al. |

FOREIGN PATENT DOCUMENTS

| | | | | |
|---|---|---|---|---|
| JP | 63-500389 | | | 2/1988 |
| JP | 64-047823 | | | 2/1989 |
| JP | 08-295955 | | | 11/1996 |
| JP | 10-502418 | | | 3/1998 |
| JP | 2001-192748 | | | 7/2001 |
| JP | 2001192748 | A | * | 7/2001 |
| JP | 2002129250 | A | * | 5/2002 |
| JP | 2003-129268 | | | 5/2003 |
| WO | WO 86/07097 | | | 12/1986 |
| WO | WO 96/04407 | | | 2/1996 |
| WO | WO 03/008156 | | | 5/2003 |

OTHER PUBLICATIONS

Machine translation of JP 2001-192748.*

A. Martinez, et al., "A chemical and electrochemical study of titanium ions in the molten equimolar $CaCl_2$ + NaCl mixture at 550° C", Journal of Electroanalytical Chemistry 449, (1998) pp. 67-80.

* cited by examiner

METHOD FOR PRODUCING TI OR TI ALLOY THROUGH REDUCTION BY CA

TECHNICAL FIELD

The present invention relates to a method for producing Ti or a Ti alloy through reduction by Ca, in which a metallic chloride containing $TiCl_4$ is reduced by Ca to produce metallic Ti or the Ti alloy.

BACKGROUND ART

The Kroll method for reducing $TiCl_4$ by Mg is generally used as an industrial production method of the metallic Ti. In the Kroll method, the metallic Ti is produced through a reduction step and a vacuum separation step. In the reduction step, $TiCl_4$ which is of a raw material of Ti is reduced in a reactor vessel to produce the sponge metallic Ti. In the vacuum separation step, unreacted Mg and $MgCl_2$ formed as a by-product are removed from the sponge metallic Ti produced in the reactor vessel.

To explain the reduction step in detail, in the reduction step, the reactor vessel is filled with the molten Mg, and the $TiCl_4$ liquid is supplied from above a liquid surface of the molten Mg. This allows $TiCl_4$ to be reduced by Mg in the vicinity of the liquid surface of the molten Mg to generate the particulate metallic Ti. The generated metallic Ti is sequentially sedimented downward. At the same time, the molten $MgCl_2$ is generated as the by-product in the vicinity of the liquid surface. A specific gravity of molten $MgCl_2$ is larger than that of the molten Mg. The molten $MgCl_2$ which is of the by-product is sedimented downward due to the specific-gravity difference, and the molten Mg emerges in the liquid surface instead. The molten Mg is continuously supplied to the liquid surface by the specific-gravity difference substitution, and the reaction is continued.

In the metallic Ti production by the Kroll method, a high-purity product can be produced. However, in the Kroll method, because the product is produced in a batch manner, a production cost is increased and the product becomes remarkably expensive. One of factors of the increased production cost is the difficulty of enhancing a feed rate of $TiCl_4$. The following is cited as the reason why the feed rate of $TiCl_4$ is restricted.

In order to improve productivity in the Kroll method, it is effective to enhance the feed rate of $TiCl_4$ which is of the raw material of Ti, i.e., to enhance a supply amount of molten Mg to the liquid surface per unit area or unit time. However, when the feed rate is excessively enhanced, the rate of the specific-gravity difference substitution cannot respond to the reaction rate, $MgCl_2$ remains in the liquid surface, and $TiCl_4$ is supplied to the $MgCl_2$, which reduces utilization efficiency of $TiCl_4$.

As a result, the supplied raw material becomes unreacted generation gas (referred to as unreacted gas) such as unreacted $TiCl_4$ gas and unreacted $TiCl_3$ gas, and the unreacted gas is discharged outside the reactor vessel. It is necessary to avoid the generation of the unreacted gas, because a rapid increase in inner pressure of the reactor vessel is associated with the generation of the unreacted gas. There is a limit of the feed rate of $TiCl_4$ which is of the raw material of Ti for the above reasons.

When the feed rate of $TiC_4$ is enhanced, a precipitation amount of Ti is increased in the inner surface of the reactor vessel above the liquid surface. As the reduction reaction proceeds, the liquid surface of the molten Mg rises intermittently. Therefore, the precipitated Ti in the inner surface of the upper portion of the reactor vessel is immersed in the molten Mg in a late stage of the reduction reaction, which causes the effective area of the Mg liquid surface to be decreased to reduce the reaction rate. In order to suppress the reduction of reaction rate, it is necessary that the feed rate of $TiCl_4$ be restricted to prevent the Ti precipitation in the inner surface of the upper portion of the reactor vessel. Japanese Patent Application Publication No. 8-295955 proposes a countermeasure for suppressing the Ti precipitation in the inner surface of the upper portion of the reactor vessel. However, the countermeasure proposed in Japanese Patent Application Publication No. 8-295955 is not sufficient.

In the Kroll method, since the reaction is performed only in the vicinity of the liquid surface of the molten Mg solution in the reactor vessel, an exothermic area is narrowed. Therefore, when $TiCl_4$ is supplied at a high rate, cooling cannot keep up with the supply of $TiCl_4$ in the reaction area. This also causes the feed rate of $TiCl_4$ to be restricted.

Although the feed rate of $TiCl_4$ is not directly affected, in the Kroll method, Ti is generated in the particulate form in the vicinity of the liquid surface of the molten Mg solution, and Ti is sedimented. However, because of wetting properties (adhesion properties) of the molten Mg, the generated Ti particles are sedimented while aggregated, and the Ti particles is sintered to grow in particulate size of the Ti particles at a melt temperature condition during the sedimentation, which makes it difficult to retrieve the Ti particles out of the reactor vessel. Therefore, in the Kroll method, the continuous production is difficult to perform, and the improvement of the productivity is blocked. This is why the Ti is produced in the batch manner in the form of the sponge titanium by the Kroll method.

With reference to the Ti production methods except for the Kroll method, for example, U.S. Pat. No. 2,205,854 describes that, in addition to Mg, Ca can be used as the reducing agent of $TiCl_4$. U.S. Pat. No. 4,820,339 describes a method for producing Ti through the reduction reaction by Ca, in which the molten salt of $CaCl_2$ is held in the reactor vessel, the metallic Ca powder is supplied into the molten salt from above, Ca is dissolved in the molten salt, and the $TiCl_4$ gas is supplied from below to react the dissolved Ca with $TiCl_4$ in the molten salt of $CaCl_2$.

In the reduction by Ca, the metallic Ti is generated from $TiCl_4$ by the reaction of the following chemical formula (a), and $CaCl_2$ is also generated as the by-product at the same time. Ca has an affinity for Cl stronger than that of Mg, and Ca is suitable for the reducing agent of $TiCl_4$ in principle:

$$TiCl_4+2Ca \rightarrow Ti+2CaCl_2 \quad (a)$$

Particularly, in the method described in U.S. Pat. No. 4,820,339, Ca is used while dissolved in the molten $CaCl_2$. When the reduction reaction by Ca is utilized in the molten $CaCl_2$, like the Kroll method, $TiCl_4$ is supplied to the liquid surface of the reducing agent in the reactor vessel, which enlarges the reaction area compared with the case in which the reaction area is restricted in the vicinity of the liquid surface. Accordingly, because the exothermic area is also enlarged to facilitate the cooling, the feed rate of $TiCl_4$ which is of the raw material of Ti can be largely enhanced, and the remarkable improvement of the productivity can be also expected.

However, it is difficult that the method described in U.S. Pat. No. 4,820,339 is adopted as the industrial Ti production method. In the case where the metallic Ca powder is used as the reducing agent, because the metallic Ca powder is highly expensive, the purchase and use of the metallic Ca powder leads to increase the production cost to be higher than that of the Kroll method in which the feed rate of $TiCl_4$ is restricted. In addition, highly reactive Ca is extremely difficult to handle, which also causes the factor of blocking the industrial application of the method for producing Ti through the reduction by Ca.

U.S. Pat. No. 2,845,386 describes the Olsen method as another Ti production method. The Olsen method described in U.S. Pat. No. 2,845,386 is a kind of oxide direct-reduction method for directly reducing $TiO_2$ by Ca. Although the oxide direct-reduction method is highly efficient, since it is necessary to use expensive high-purity $TiO_2$, the oxide direct-reduction method is not suitable for producing the high-purity Ti.

DISCLOSURE OF THE INVENTION

It is an object of the present invention to provide a method for economically producing a high-purity metallic Ti or a high-purity Ti alloy with high efficiency without using an expensive reducing agent.

In order to achieve the above object, the present inventors focus on the method for reducing $TiCl_4$ by Ca. In the method for producing Ti through the reduction by Ca, the $TiCl_4$ solution is supplied to the liquid surface of the molten Ca solution in the reactor vessel. This enables $TiCl_4$ to be reduced by Ca in the vicinity of the liquid surface of the molten Ca solution to generate the particulate metallic Ti. The generated metallic Ti is sequentially sedimented downward.

At the same time when the metallic Ti is sedimented, the molten $CaCl_2$ is generated as the by-product in the vicinity of the liquid surface. The specific gravity of molten $CaCl_2$ is larger than that of the molten Ca. Because of the specific gravity difference, the molten $CaCl_2$ which is of the by-product is sedimented downward, and the molten Ca emerges in the liquid surface instead. The molten Ca is continuously supplied to the liquid surface by the specific-gravity difference substitution, and the reaction is continued.

Although the method of the present invention is seemingly similar to the conventional method for reducing $TiCl_4$ by Mg, the method of the present invention differs largely from the conventional method in that Ca is dissolved in the molten $CaCl_2$ which is of the by-product. That is, Ca is dissolved in $CaCl_2$ up to about 1.5% while Mg is hardly dissolved in $MgCl_2$. The Ca dissolution phenomenon makes it difficult to separate Ca and $Cl_2$ in a reduction step and in a Ca electrolytic production step of electrolyzing the molten $CaCl_2$ which is of the by-product into Ca and $Cl_2$. Therefore, conventionally it is thought that the Ca dissolution phenomenon is an obstacle of practical application, and both the Ca dissolution phenomenon and existence of the molten $CaCl_2$ are avoided. That is, the dissolution of Ca in $CaCl_2$ is the big obstacle in applying the reduction by Ca for the industrial production of Ti.

Under the circumstances, the present inventors notice that the dissolution phenomenon of Ca in $CaCl_2$ becomes rather an advantage, and the present inventors intend to positively utilize both the dissolution phenomenon of Ca in $CaCl_2$ and the molten $CaCl_2$. That Ca is dissolved in the molten $CaCl_2$ means that the generation reaction of Ti through the reduction by Ca can proceed in the molten $CaCl_2$.

When the reduction reaction by Ca in the molten $CaCl_2$ is utilized, a reaction area which is conventionally restricted in the vicinity of the liquid surface of the reducing agent in the reactor vessel is remarkably enlarged, and cooling can be readily performed because the exothermic area is enlarged. The feed rate of $TiCl_4$ which is of a raw material of Ti can largely be increased, productivity can remarkably be improved. Because the dissolution phenomenon of Ca in the molten $CaCl_2$ is utilized, the strict separation operation of Ca and $CaCl_2$ is not required any more, which allows the obstacle in the practical application caused by the strict separation operation to be simultaneously removed.

The method for producing Ti or the Ti alloy through the reduction by Ca is named the "OYIK method" after initials of four persons of Ogasawara, Yamaguchi, Ichihasi, and Kanazawa who deeply engages in conception, development, and completion. In the method of the present invention, because the Ti particles are generated through the reduction by Ca in the molten salt containing $CaCl_2$, the reduction reaction area is enlarged, and the exothermic area is also enlarged at the same time.

In comparison of vapor pressure at 850° C., the vapor pressure of Mg is 6.7 kPa (50 mmHg), whereas the vapor pressure of Ca is as extremely small as 0.3 kPa (2 mmHg). The reduction by Ca is much smaller than the reduction by Mg in terms of the precipitation amount of Ti on an upper inner surface of the reactor vessel because of the difference in vapor pressure.

Therefore, in the OYIK method, the feed rate of $TiCl_4$ can largely be increased. Further, Ca is inferior in wetting properties (adhesion properties) to Mg, and Ca adhering to the precipitated Ti particles is dissolved in $CaCl_2$, so that aggregation becomes less in the generated titanium particles and sintering is significantly lessened. Therefore, the generated Ti can be taken out from the reactor vessel in the particle state, and the Ti production can continuously be operated.

The present invention relates to the method for producing Ti or the Ti alloy through the reduction by Ca in the molten $CaCl_2$, and the present invention mainly includes the following "first, second, third, and fourth production methods".

1. First Production Method (1) A method for producing Ti or a Ti alloy through reduction by Ca comprises a reduction step of holding a molten salt in a reactor vessel, the molten salt containing $CaCl_2$, Ca being dissolved in the molten salt, and of reacting a metallic chloride containing $TiCl_4$ with Ca in the molten salt to generate Ti particles or Ti alloy particles in the molten salt; and a separation step of separating the Ti particles or Ti alloy particles, generated in the molten salt, from the molten salt.

(2) The first production method is a basic method based on the reduction reaction by Ca in the molten $CaCl_2$, and the Ti particles or the Ti alloy particles are generated in the molten $CaCl_2$ solution in the reduction step, so that the feed rate of $TiCl_4$ which is of the raw material of Ti can be increased. Further, since the Ti particles are generated in the molten $CaCl_2$, the aggregation of the particles as well as particle growth caused by the sintering are significantly lessened, so that the Ti particles can be taken out from the reactor vessel. Therefore, the method enables the continuous operation, and the high-purity metallic Ti or the high-purity Ti alloy can economically be produced with high efficiency.

2. Second Production Method (1) A method for producing Ti or a Ti alloy through a reduction reaction by Ca comprises a reduction step of holding a molten salt in a reactor vessel, the molten salt containing $CaCl_2$, Ca being dissolved in the molten salt, and reacting a metallic chloride containing $TiCl_4$ with Ca in the molten salt to generate Ti particles or Ti alloy particles in the molten salt; a discharge step of discharging the molten salt outside the reactor vessel, where the molten salt being used for the generation of the Ti particles or Ti alloy particles; a Ti separation step of separating the Ti particles or Ti alloy particles from the molten salt inside the reactor vessel or outside the reactor vessel; an electrolysis step of electrolyzing the molten salt to generate Ca, the molten salt being discharged outside the reactor vessel; and a return step of introducing Ca solely or along with the molten salt into the reactor vessel, Ca being generated by the electrolysis, wherein a Ca source is circulated.

(2) In the second production method, the Ca source is circulated, and the Ca concentration is changed by the electrolysis during the procedure of circulating the Ca source, which allows the elimination of the Ca replenishment from the outside of the system, and also allows the elimination of the operation in which Ca is solely handled. Therefore, the high-purity metallic Ti or the high-purity Ti alloy can economically be produced with higher efficiency.

3. Third and Fourth Production Methods (1) A method for producing Ti through reduction by Ca (hereinafter referred to as third production method) comprises a reduction step of holding a molten salt in a reactor vessel, the molten salt containing $CaCl_2$, Ca being dissolved in the molten salt, and reacting a metallic chloride containing $TiCl_4$ with Ca in the molten salt to generate Ti particles in the molten salt; and a separation step of separating the Ti particles, generated in the molten salt, from the molten salt, wherein a Ca concentration C (mass %) of the molten salt in the reactor vessel is C>0 mass %, and wherein a temperature of the molten salt ranges from 500 to 1000° C., and wherein a relationship between the Ca concentration C (mass %) and the temperature of the molten salt satisfies the following formula (1):

$$C \geqq 0.002 \times T - 1.5 \quad (1)$$

where T is a temperature (° C.) of the molten salt in the reactor vessel.

(2) A method for producing Ti through reduction by Ca, in which a molten salt whose Ca concentration is increased is used for reduction of $TiCl_4$ in a reduction step, where the molten salt being generated in an electrolysis step, (hereinafter referred to as third production method), comprises the reduction step of holding a molten salt in a reactor vessel, where the molten salt containing $CaCl_2$ and Ca being dissolved in the molten salt, and reacting a metallic chloride containing $TiCl_4$ with Ca in the molten salt to generate Ti particles in the molten salt; a separation step of separating the Ti particles, generated in the molten salt, from the molten salt; a separation step of separating the Ti particles, generated in the molten salt, from the molten salt; and the electrolysis step of increasing the Ca concentration by electrolyzing the molten salt in which the Ca concentration is decreased in association with the generation of the Ti particles, wherein a Ca concentration C (mass %) of the molten salt in the reactor vessel is C>0 mass %, and wherein a temperature of the molten salt ranges from 500 to 1000° C., and wherein a relationship between the Ca concentration C (mass %) and the temperature of the molten salt satisfies the following expression (1):

$$C \geqq 0.002 \times T - 1.5 \quad (1)$$

where T is a temperature (° C.) of the molten salt in the reactor vessel.

(3) In the third and fourth production methods, Ca is used as the reducing agent, recovery efficiency of Ti is never reduced by generating $TiCl_3$ and $TiCl_2$ when $TiCl_4$ is reacted with Ca in the molten salt containing $CaCl_2$, and a generation yield of Ca is never reduced in the electrolysis step of separating $CaCl_2$ into Ca and $Cl_2$ by the electrolysis.

BEST MODE FOR CARRYING OUT THE INVENTION

Figure 1:
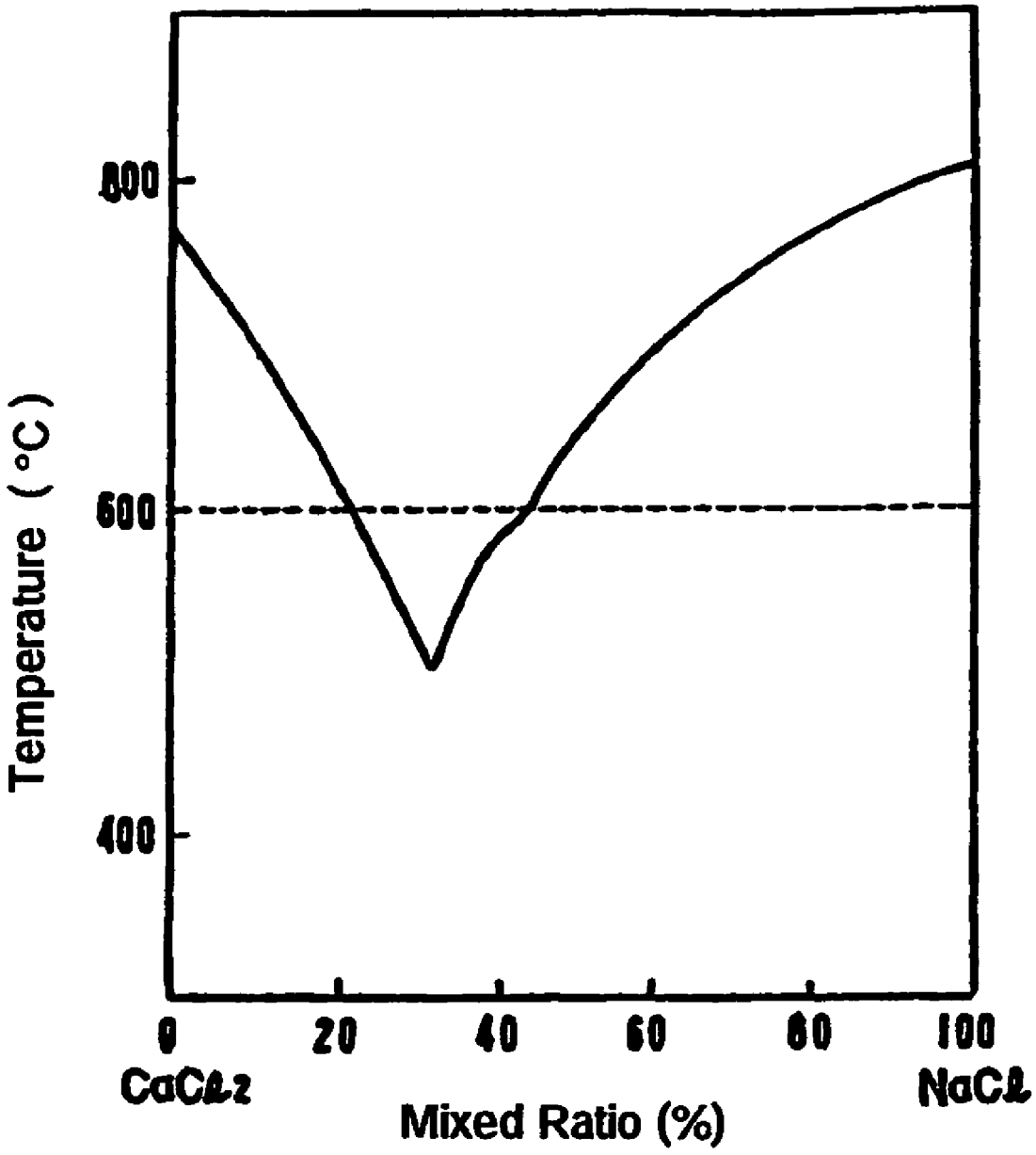
FIG. 1 is a view showing a relationship between a mixed ratio and a melting point in a mixed molten salt of $CaCl_2$ and NaCl.

Contents of "First, second, third, and fourth production methods" of the present invention including detailed examples will be described while divided into each of the methods.

1. First Production Method

The first production method comprises a reduction step and a separation step. In the reduction step, a molten salt is held in a reactor vessel, and a metallic chloride containing $TiCl_4$ is reacted with Ca in the molten salt to generate Ti particles or Ti alloy particles in the molten salt. The molten salt contains $CaCl_2$, and Ca is dissolved in the molten salt. In the separation step, the Ti particles or Ti alloy particles, generated in the molten salt, are separated from the molten salt.

For a supply mode of $TiCl_4$ to the molten $CaCl_2$ solution, it is particularly preferable that $TiCl_4$ be directly supplied in the gas state into the molten $CaCl_2$ solution, because contact efficiency of $TiCl_4$ to Ca in the molten $CaCl_2$ solution can be enhanced. It is also possible that $TiCl_4$ is supplied to the liquid surface of the molten $CaCl_2$ solution, or it is also possible that the liquid or gaseous $TiCl_4$ is supplied to the liquid surface or into the liquid of the molten Ca solution held on the molten $CaCl_2$ solution.

When the $TiCl_4$ liquid is supplied to the liquid surface of the molten Ca solution held on the molten $CaCl_2$ solution, the reaction is continued in a range of a molten Ca layer to a molten $CaCl_2$ layer. Therefore, even if the rate of the specific-gravity difference substitution cannot respond to the reaction rate due to the increase in feed rate of $TiCl_4$, the generation of Ti can be continued and the generation of the unreacted gas can also be suppressed. That is, when the molten Ca solution is thinly held on the molten $CaCl_2$ solution to an extent in which Ca in the molten $CaCl_2$ solution can be utilized, $TiCl_4$ can be supplied only to the liquid surface of the molten Ca solution.

Further, when the method for reducing $TiCl_4$ by Ca is applied to the supply of $TiCl_4$, there are various advantages compared with the Kroll method in which the reduction is performed by Mg.

In the Kroll method in which the reduction is performed by Mg, the $TiCl_4$ liquid is supplied to the liquid surface of the molten Mg solution. Conventionally it is tried that the $TiCl_4$ gas is supplied into the molten Mg solution. However, as described above, since the Mg has the large vapor pressure, Mg vapor intrudes in a supply nozzle to react with $TiCl_4$, and a supply pipe is choked.

The problem of nozzle choking still remains even if the $TiCl_4$ gas is supplied into the molten $MgCl_2$ solution. This is attributed to the fact that the melt is agitated by bubbling of $TiCl_4$ and sometimes the molten Mg reaches the supply nozzle, although a choking frequency of the supply pipe is decreased. As much as anything, even if $TiCl_4$ is supplied to the molten $MgCl_2$ solution, because Mg is not dissolved in the melt, the Ti precipitation reaction is difficult to occur.

On the contrary, in the method of reducing $TiCl_4$ by Ca, the nozzle choking is hardly generated when the $TiCl_4$ gas is supplied into the molten $CaCl_2$ solution. Therefore, the $TiCl_4$ gas can be supplied into the molten $CaCl_2$ solution, and the $TiCl_4$ gas can also be supplied into the molten Ca solution. That the molten Ca has the small vapor pressure is cited as the reason why the nozzle choking is hardly generated.

As described above, in the OYIK method which is of a method for reducing $TiCl_4$ by Ca, it is particularly preferable that $TiCl_4$ be directly supplied in the gas state into the molten $CaCl_2$ solution, and this supply mode can be applied with no problem in the actual operation. It is also possible that $TiCl_4$ is supplied to the liquid surface of the molten $CaCl_2$ solution, or it is also possible that the liquid or gaseous $TiCl_4$ is supplied to the liquid surface or into the liquid of the molten Ca solution held on the molten $CaCl_2$ solution. These supply modes can also be applied with no problem in the actual operation.

In handling the Ti particles generated in the molten $CaCl_2$ solution, it is also possible that the Ti particles are separated from the molten $CaCl_2$ solution in the reactor vessel. In this case, the production mode becomes the batch manner. In order to improve the productivity in the Ti production, the Ti particles and the molten $CaCl_2$ solution may be separated from each other outside the reactor vessel by utilizing the Ti generated in the particulate form to discharge the Ti particles outside the reactor vessel along with the molten $CaCl_2$ solution. The Ti particles can simply be separated from the molten $CaCl_2$ solution by a squeezing operation by mechanical compression and the like.

The $CaCl_2$ is generated as the by-product at the same time when Ti is generated in the molten $CaCl_2$ solution. The $CaCl_2$ is also generated as the by-product when Ti is generated in the molten Ca solution held on the molten $CaCl_2$ solution. Therefore, it is preferable that $CaCl_2$ which is of the by-product in the reactor vessel be discharged outside the reactor vessel according to the generation of $CaCl_2$ in the reactor vessel. It is more preferable that $CaCl_2$ be discharged at a stage after $CaCl_2$ is used for the generation of Ti, i.e., at the stage in which Ca dissolved in $CaCl_2$ is consumed.

In handling $CaCl_2$ discharged outside the reactor vessel, it is preferable that $CaCl_2$ be electrolyzed into Ca and $Cl_2$ to use Ca generated by the electrolysis for the generation reaction of Ti in the reactor vessel. It is also preferable that $Cl_2$ generated by the electrolysis be reacted with $TiO_2$ to generate $TiCl_4$ for use in the generation reaction of Ti in the reactor vessel.

The expensive Ca can be used as the reducing agent over and over by forming the above cycle, which allows the production cost to be reduced. The cost for generating $TiCl_4$ can also be reduced. It should particularly be noted that the Ca production cost is reduced because it is not necessary that Ca and $CaCl_2$ be strictly separated in Ca electrolytic production step.

As described above, one of the reasons why the Ca was not used in the industrial production of the metallic Ti is the difficulty of separating Ca and $CaCl_2$. To explain the difficulty in detail, Mg is produced by electrolyzing $MgCl_2$, and the generated Mg can efficiently be recovered because Mg is hardly dissolved in $MgCl_2$. Similarly to Mg, Na can efficiently be produced by electrolyzing NaCl.

On the other hand, Ca is produced by electrolyzing $CaCl_2$, and it is difficult to efficiently produce only Ca because the generated Ca is dissolved in $CaCl_2$. There is also a phenomenon in which the dissolved Ca returns to $CaCl_2$ by a back reaction. Therefore, the production efficiency of Ca becomes worse. In the electrolytic production of Ca, for example, the improvement of a recovery rate of Ca is performed by cooling an electrode. However, the production cost of Ca is sill high. Therefore, Ca was not used as the reducing agent in the conventional Ti production.

However, in the OYIK method, since $CaCl_2$ in which Ca is dissolved is positively used, even if $CaCl_2$ is mixed in Ca in the electrolysis step, there is generated no problem, and it is not necessary that only Ca be completely separated. That is, Ca can be put in the reduction reactor vessel from an electrolytic cell along with $CaCl_2$, so that the electrolytic production cost of Ca can be reduced. When a partition wall is placed between the electrodes, or when a unidirectional melt flow is formed, the back reaction of Ca dissolved in $CaCl_2$ can also be suppressed.

In the OYIK method, $CaCl_2$ having the melting point of 780° C. is used as the molten salt. When the temperature of the molten salt is decreased, durability of the reactor vessel can be increased and vaporization of Ca or the salt can be suppressed from the liquid surface. Therefore, it is preferable that the temperature of the molten salt be lower. In order to decrease the temperature of the molten salt, it is necessary that a mixed salt of $CaCl_2$ and another salt be used as the molten salt.

FIG. 1 is a view showing a relationship between a mixed ratio and the melting point in the mixed molten salt of $CaCl_2$ and NaCl. As shown in FIG. 1, when the mixed salt with NaCl is formed, the melting point of the molten salt can be decreased to about 500° C. The melting point of the sole $CaCl_2$ is about 780° C., and the melting point of the sole NaCl is over 800° C. However, when $CaCl_2$ and NaCl are mixed together, the melting point is decreased to about 500° C. at the minimum. When the mixed ratio of $CaCl_2$ ranges from 30 to 40%, the melting point of the mixed salt is decreased to 600° C. or less.

In the case where the molten Ca solution is held on the molten salt, it is preferable that the molten salt be maintained at the temperature of not less than 838° C. which is of the melting point of Ca. The temperature of the molten salt cannot be decreased to 838° C. or less in order to maintain the Ca layer in the molten state. However, the melting point of the Ca layer can be decreased by mixing other alkali-earth metals or alkali metals with Ca.

For example, the melting point can be decreased to 516° C. by mixing Ca and Mg. Only Ca is dissolved into the molten salt from the mixture of Ca and Mg, and Mg is hardly dissolved. Therefore, the Ti generation reaction of the present invention in which $TiCl_4$ is reduced by Ca dissolved in $CaCl_2$ can proceed even in the case of the use of the molten metal in which Mg is added to Ca. Accordingly, the present invention can be realized while the molten salt is maintained at lower temperature by the use of the mixed salt.

Basically the $TiCl_4$ gas is used as the raw material of Ti. However, Ti can also be produced by mixing the $TiCl_4$ gas and another metallic chloride gas. Because the $TiCl_4$ gas and another metallic chloride gas are simultaneously reduced by Ca, the Ti alloy particles can be produced.

1-1. FIRST EXAMPLE

Figure 2:
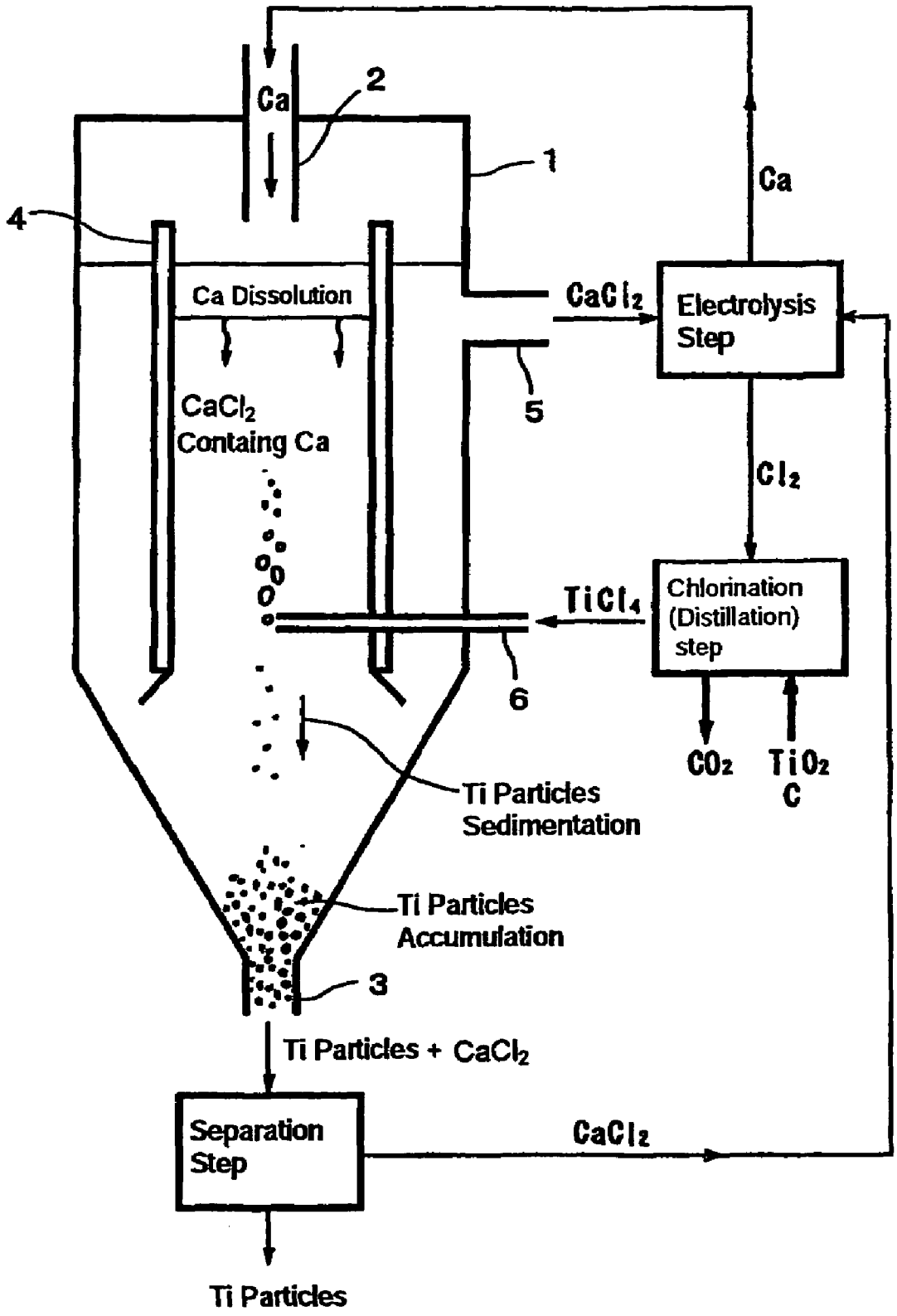
FIG. 2 is a view showing a configuration example of a metallic Ti production apparatus explaining a first example of first production method (also including third and fourth examples) according to the present invention.

FIG. 2 is a view showing a configuration example of a metallic Ti production apparatus explaining first example of the first production method according to the present invention. A cylindrical reactor vessel 1 is used in the first example. The reactor vessel 1 is a closed vessel made of iron. A reducing agent supply pipe 2 is provided in a ceiling portion of the reactor vessel 1. The reducing agent supply pipe 2 supplies Ca which is of the reducing agent. A bottom portion of the reactor vessel 1 is formed in a tapered shape in which a diameter of the reactor vessel 1 is gradually shrunk downward in order to promote the discharge of the generated Ti particles. A Ti discharge pipe 3 which discharges the generated Ti particles is provided in a central portion of a lower end of the reactor vessel 1.

On the other hand, in the reactor vessel 1, a cylindrical separation wall 4 in which a heat exchanger is incorporated is arranged at the position where a predetermined space from the inner surface of a straight body portion of the reactor vessel 1 is set. A molten salt discharge pipe 5 which laterally discharges $CaCl_2$ in the vessel is provided in an upper portion of the reactor vessel 1. A raw material supply pipe 6 is provided in a lower portion of the reactor vessel 1, and the raw material supply pipe 6 pierces through the separation wall 4 so as to reach the central portion of the vessel. The raw material supply pipe 6 supplies $TiCl_4$ which is of the raw material of Ti.

In the actual operation, the molten $CaCl_2$ solution in which Ca is dissolved is held as the molten salt in the reactor vessel 1. The liquid surface of the molten $CaCl_2$ solution is set at a level higher than the molten salt discharge pipe 5 and lower than an upper end of the separation wall 4. In the separation wall 4, the molten Ca solution is held as the molten metal containing Ca on the molten $CaCl_2$ solution.

In this state of things, the $TiCl_4$ gas which is of the metallic chloride containing $TiCl_4$ is supplied from the raw material supply pipe 6 to the molten $CaCl_2$ solution, located inside the separation wall 4. Therefore, $TiCl_4$ is reduced by Ca in the molten $CaCl_2$ solution located inside the separation wall 4, and the particulate metallic Ti is generated in the molten $CaCl_2$ solution.

The $TiCl_4$ gas supplied into the molten $CaCl_2$ solution comes up as many bubbles in the molten $CaCl_2$ solution to promote the stirring of the molten $CaCl_2$ solution, which allows the reaction efficiency to be enhanced.

The Ti particles generated in the molten $CaCl_2$ solution inside the separation wall 4 of the reactor vessel 1 are sedimented in the molten $CaCl_2$ solution and precipitated on the bottom portion in the reactor vessel 1. The precipitated Ti particles are accordingly discharged from the Ti discharge pipe 3 along with the molten $CaCl_2$ solution, and the Ti particles are sent to the separation step.

The molten $CaCl_2$ solution in which Ca is consumed by the reduction reaction inside the separation wall 4 comes up in the outside of the separation wall 4 through the lower portion of the separation wall 4, and the molten $CaCl_2$ solution is discharged from the molten salt discharge pipe 5. The discharged molten $CaCl_2$ solution is sent to the electrolysis step.

In the separation wall 4, Ca is dissolved and replenished to the molten $CaCl_2$ solution from the molten Ca solution held on the molten $CaCl_2$ solution. At the same time, Ca is replenished from the reducing agent supply pipe 2 onto the molten $CaCl_2$ solution inside the separation wall 4.

Thus, the metallic Ti is continuously produced in the reactor vessel 1. In the separation wall 4, the molten $CaCl_2$ solution in which Ca is dissolved is used, and the reduction reaction is performed by Ca in the molten $CaCl_2$ solution, so that the reaction area can be substantially enlarged to the whole of the inside of the separation wall 4 to enhance the feed rate of $TiCl_4$. The high-purity Ti particles are produced with high efficiency by combining these factors.

The separation wall 4 can enhance the reaction efficiency by obstructing the mixing of the molten $CaCl_2$ solution containing the large amount of prior-to-use Ca and the molten $CaCl_2$ solution containing the little amount of Ca after use.

On the other hand, in the separation step, the Ti particles discharged along with the molten $CaCl_2$ solution from the reactor vessel 1 are separated from the molten $CaCl_2$ solution. Specifically, the Ti particles are compressed to squeeze the molten $CaCl_2$ solution, and then the Ti particles are washed. The molten $CaCl_2$ solution obtained in the separation step is sent to the electrolysis step along with the molten $CaCl_2$ solution discharged from the reactor vessel 1.

In the electrolysis step, the molten $CaCl_2$ solutions introduced from the reactor vessel 1 and the separation step are separated into Ca and $Cl_2$ gas by the electrolysis, and Ca is returned into the reactor vessel 1. At this point it is not necessary that Ca be completely separated from $CaCl_2$. There is no problem in that Ca is returned into the reactor vessel 1 along with $CaCl_2$. This is because $CaCl_2$ in which Ca is dissolved is used in the reactor vessel 1. The ease of the separating operation enables the reduction of the Ca electrolysis production cost.

The $Cl_2$ gas generated in the electrolysis step is carried to the chlorination step. In the chlorination step, $TiCl_4$ is produced by the chlorination of $TiO_2$. Oxygen which is of the by-product can be discharged in the form of $CO_2$ by simultaneously using carbon powder. The produced $TiCl_4$ is introduced into the reactor vessel 1 through the raw material supply pipe 6. Thus, Ca and $Cl_2$ gas which are of the reducing agent are cycled by the circulation of $CaCl_2$. That is, the metallic Ti is continuously produced by substantially replenishing $TiO_2$ and C.

1-2. SECOND EXAMPLE

Figure 3:
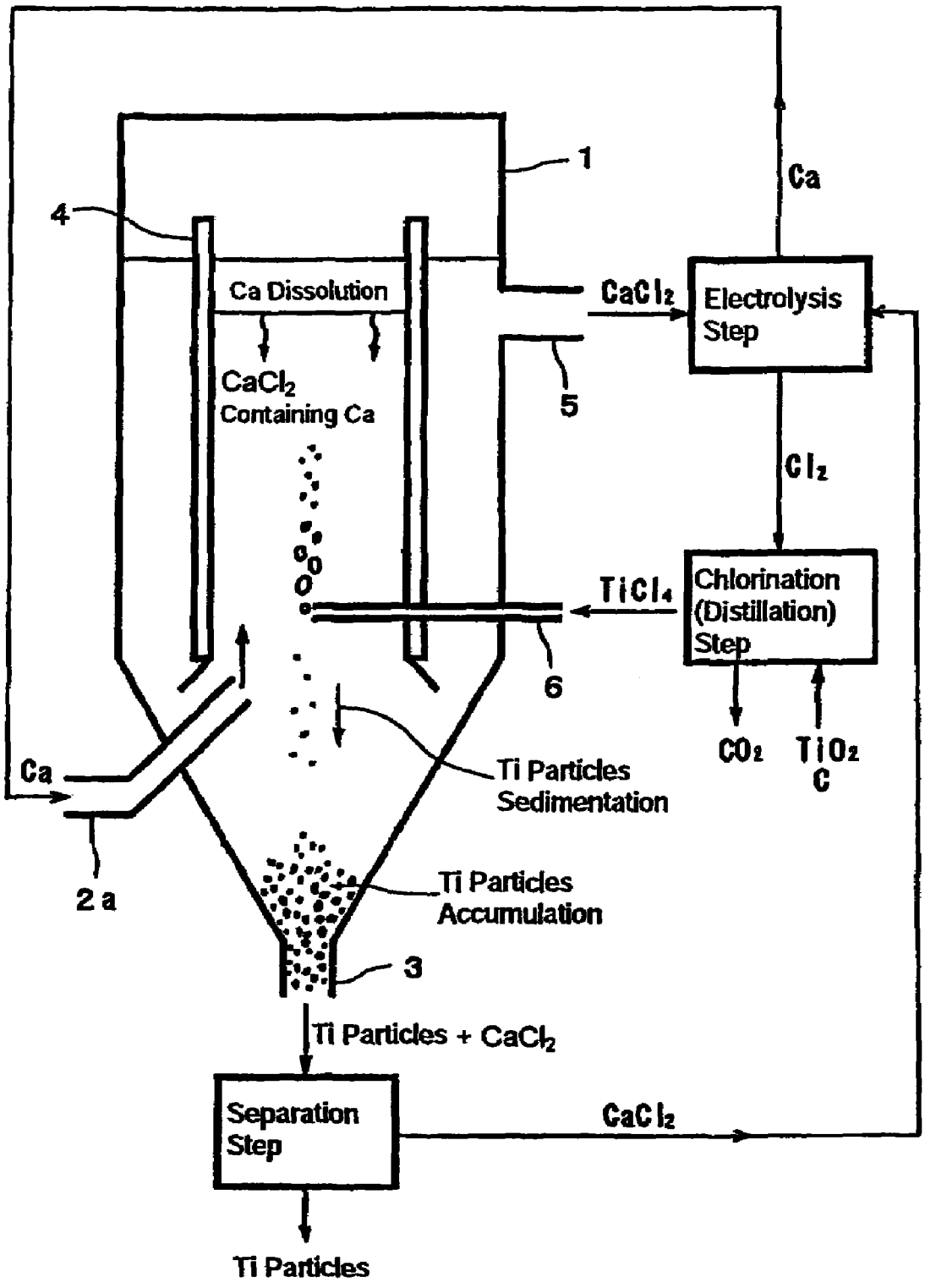
FIG. 3 is a view showing a configuration example of a metallic Ti production apparatus explaining a second example of the first production method according to the present invention.

FIG. 3 is a view showing a configuration example of a metallic Ti production apparatus explaining second example of the first production method according to the present invention. The second example differs from the first example in that the reducing agent supply pipe 2 is provided in the lower portion of the reactor vessel 1 and Ca is supplied to the inside of the separation wall 4 from the lower portion of the reactor vessel 1.

In the second example, the molten Ca solution which is of the reducing agent floats upward in the inside of the separation wall 4 by the specific-gravity difference between the molten Ca solution and the molten $CaCl_2$ solution. Because Ca is dissolved in $CaCl_2$ in the floating process, dissolution efficiency of Ca is enhanced. The floating molten Ca remains on the upper portion of the molten $CaCl_2$ solution, and Ca is dissolved into the lower portion of the molten $CaCl_2$ solution.

1-3. THIRD EXAMPLE

Figure 4:
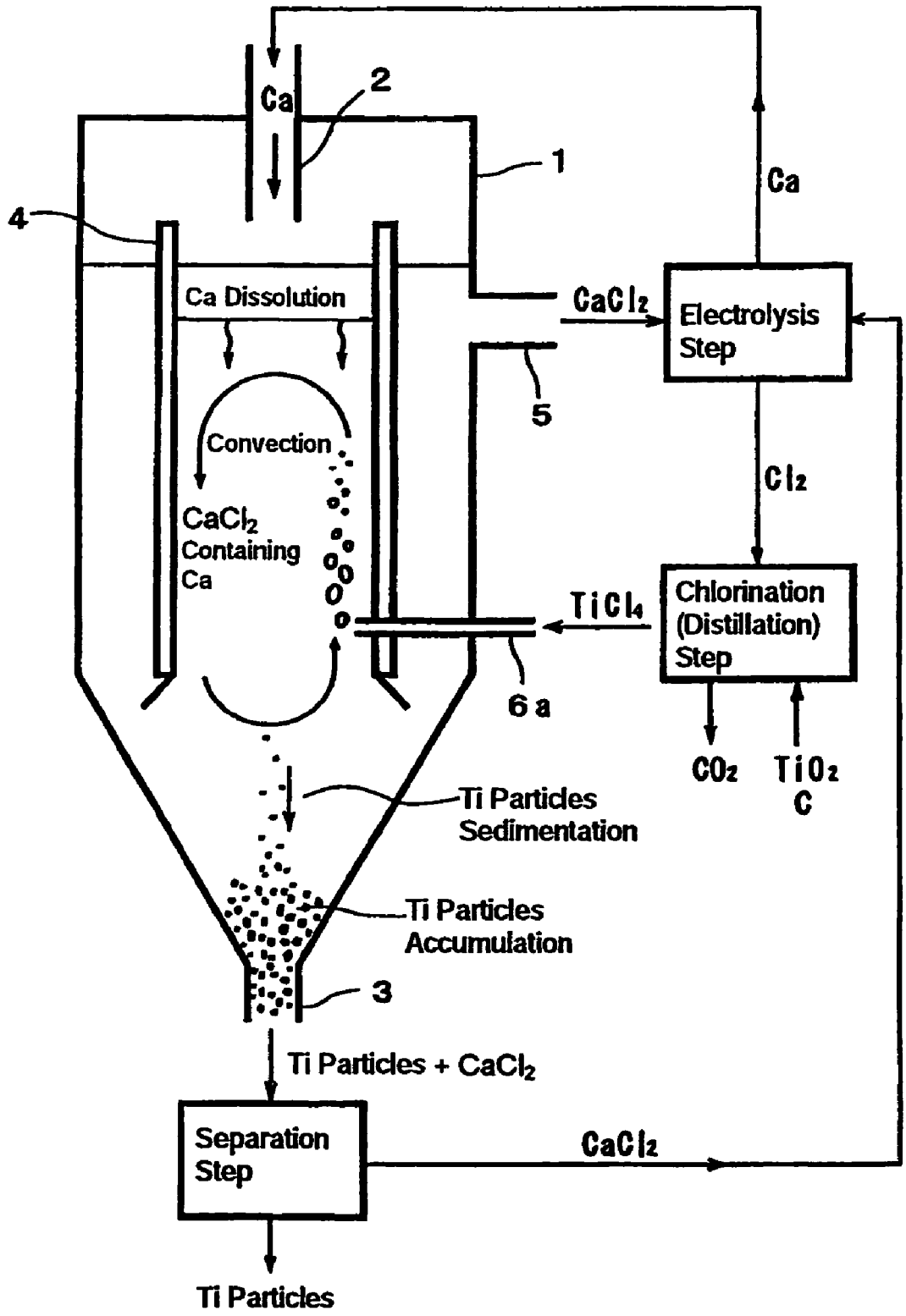
FIG. 4 is a view showing a configuration example of a metallic Ti production apparatus explaining a third example of the first production method according to the present invention.

FIG. 4 is a view showing a configuration example of a metallic Ti production apparatus explaining third example of the first production method according to the present invention. The third example differs from other examples in terms of the position of a raw material supply pipe 6*a*. The raw material supply pipe 6 supplies $TiCl_4$ to the central portion of the vessel in other examples, whereas $TiCl_4$ is supplied to the position biased from the center inside the separation wall 4 in the third example. According to the configuration of the third example, in the separation wall 4, convection of the molten $CaCl_2$ solution is generated by gas lift of the $TiCl_4$ gas. The dissolution of Ca in $CaCl_2$ is promoted by the convection of $CaCl_2$, which enhances the dissolution efficiency.

2. Second Production Method

In order to industrially establish the method for producing Ti through the reduction by Ca production method, the present inventors focus on the necessity of economically replenishing Ca in the molten salt in which Ca is consumed by the reduction reaction, and the present inventors has an idea of a method, in which the molten salt is circulated to increase the amount of Ca in the molten salt during the circulation, as means for replenishing Ca. That is, the metallic Ti can extremely economically be produced without replenishing the metallic Ca from the outside of the system by performing a circulation cycle of a Ca source. In the circulation cycle of the Ca source, the molten salt in which Ca is consumed by the reduction reaction in the reactor vessel is discharged from the reactor vessel, Ca is generated in the molten salt by the electrolysis outside the reactor vessel, and the sole Ca or Ca with the molten salt are returned to the reduction reactor vessel again.

Particularly, in the case where Ca generated by electrolysis is returned to the reactor vessel along with the molten salt, economic efficiency is further improved because it is not necessary to solely discharge Ca. The reason is that there is the large difficulty in the case where Ca is solely extracted in the solid state, but it is relatively easy only to generate Ca in the molten salt.

The molten salt in which Ca is dissolved is most reasonable as the mode of Ca when Ca generated in the electrolysis step is introduced into the reactor vessel. Alternatively, the molten salt in which Ca is mixed or the mixture of Ca and the molten salt may be used, and a simple substance of the metallic Ca (either molten Ca or solid Ca) or a mixture of the metallic Ca and the molten salt (either dissolution or non-dissolution of Ca) may be used. As described above, the molten salt is not limited to the molten $CaCl_2$, but a mixed molten salt with another salt such as NaCl may be used.

In the typical mode of the OYIK method, the molten salt circulates the reduction step and the electrolysis step, wherein the molten salt contains $CaCl_2$, and Ca is dissolved in the molten salt. The melting point of the sole $CaCl_2$ is about 780° C., and about 1.5% Ca can be dissolved in the molten salt at the melting point. In the reduction step, Ti or the Ti alloy are generated in the reactor vessel by the reduction reaction by Ca dissolved in the molten salt. The Ca dissolved in the molten salt in the reactor vessel is consumed according to the reduction reaction, and $CaCl_2$ is simultaneously generated as the by-product. That is, a dissolved Ca concentration is decreased to thereby increase $CaCl_2$.

The molten salt whose Ca concentration is decreased according to the reduction reaction is electrolyzed in the electrolysis step, and Ca is generated and replenished. That is, $CaCl_2$ is decomposed and the dissolved Ca concentration is increased. The molten salt whose Ca concentration is recovered is returned to the reduction step, and Ti or the Ti alloy is produced by repeating the recovery of the Ca concentration. Basically the phenomenon generated with respect to Ca is only the increase or decrease in dissolved Ca concentration of the molten salt in the circulation process, and the operation in which Ca is solely extracted or replenished is not required. Accordingly, the high-purity metallic Ti or high-purity Ti alloy is efficiently and economically produced without using the expensive reducing agent.

As described above, in the OYIK method, holding the molten Ca solution on the molten salt in the reactor vessel can be adopted because Ca can be supplied from the Ca layer to the molten salt layer in the lower portion to enhance the reaction efficiency.

In the case where the molten Ca solution is held on the molten salt, it is preferable that the molten salt be maintained at temperature of not less than 838° C. which is of the melting point of Ca. The temperature of the molten salt cannot be decreased to 838° C. or less in order to maintain the Ca layer in the molten state. However, the melting point of the Ca layer can be decreased by mixing other alkali-earth metals or alkali metals with Ca.

For example, the melting point can be decreased to 516° C. by mixing Ca and Mg. Only Ca is dissolved into the molten salt from the mixture of Ca and Mg, and Mg is hardly dissolved. Therefore, the Ti generation reaction of the present invention in which $TiCl_4$ is reduced by Ca dissolved in the molten salt can proceed even in the case of the use of the molten metal in which Mg is added to Ca.

In the OYIK method, basically $CaCl_2$ having the melting point of 780° C. is used as the molten salt. However, a binary system molten salt such as $CaCl_2$—NaCl and $CaCl_2$—KCl and a ternary system molten salt such as $CaCl_2$—NaCl—KCl can also be used.

For the molten salt used in the OYIK method, when the temperature of the molten salt is decreased, the durability of the reactor vessel can be increased and the vaporization of Ca or the salt can be suppressed from the liquid surface. Therefore, it is preferable that the temperature of the molten salt be lower. The advantage in the vessel material, owing to the decrease in temperature of the molten salt, emcompasses all the steps including the reduction step and the electrolysis step. In addition, in the electrolysis step, the decrease in temperature of the molten salt suppresses solubility, the convection, diffusion, and the back reaction of Ca.

As shown in FIG. 1, in order to decrease the temperature of the molten salt, it is necessary that a mixed salt of $CaCl_2$ and another salt be used as the molten salt. That is, although the melting point of the sole $CaCl_2$ is about 780° C., and the melting point of the sole NaCl is over 800° C., when $CaCl_2$ and NaCl are mixed together, the melting point is decreased to about 500° C. at the minimum. When the mixed ratio of $CaCl_2$ ranges from 30 to 40%, the melting point of the mixed salt is decreased to 600° C. or less.

However, in the case where the mixed molten salt of $CaCl_2$ and NaCl is adopted, it is necessary to comprehend the following phenomena. As shown in the following chemical formulas (b) and (c), Ca is generated when the temperature of the molten salt is 600° C. or less, while Na is generated when the temperature of the molten salt is over 600° C.

$$2Na+CaCl_2 \rightarrow Ca+2NaCl \ (T \leqq 600^\circ \text{ C.}) \qquad (b)$$

$$Ca+2NaCl \rightarrow 2Na+CaCl_2 \ (T > 600^\circ \text{ C.}) \qquad (c)$$

Even if the temperature of the molten salt is decreased by mixing the NaCl with $CaCl_2$, Ca is not generated but Na is generated when the temperature of the molten salt is over 600° C. Therefore, in the case where the temperature of the molten salt is decreased by mixing the NaCl with $CaCl_2$, NaCl is mixed such that the temperature of the molten salt is 600° C. or less, and it is necessary to manage the molten salt at the temperatures of 600° C. or less. Otherwise, Ca dissolved in the molten salt does not exist and the reduction reaction by Ca does not proceed.

In the reduction step, it is necessary that Ca exist in the molten salt. On the contrary, in the electrolysis step of replenishing Ca, the existence of Ca becomes an obstacle. The reactions shown in the following chemical formulas (d) and (e) proceed in the electrolysis step. When Ca exists in the vicinity of the anode, current efficiency is reduced by the back reaction in which Ca reacts with the generated $Cl_2$ to return to $CaCl_2$. Therefore, in addition to installation of a separating membrane which partitions the inside of the electrolytic cell, it is preferable that the unreacted Ca is decreased as much as possible in the molten salt introduced to the electrolysis step.

$$2Cl^- \rightarrow 2e^- + Cl_2 \text{ (anode)} \quad (d)$$

$$Ca^{2+} + 2e^- \rightarrow Ca \text{ (cathode)} \quad (e)$$

In this case, Ca is dissolved in the molten salt, while Na is not dissolved in the molten salt. When the temperature of the molten salt exceeds 600° C., Na is generated instead of Ca. When the two phenomena are combined, the unreacted Ca in the molten salt introduced to the electrolysis step can be decreased. That is, the molten salt having the temperature of 600° C. or less which is discharged from the reactor vessel is temporarily heated to 600° C. or more before the molten salt is sent to the electrolysis step.

Therefore, the unreacted Ca is changed to Na in the molten salt and Na is separated from the molten salt, which allows Na to be separated and removed from the molten salt. When the molten salt is introduced to the electrolysis step after Na is separated, the unreacted reducing agent is removed in the form of Na, and re-generation of Ca is blocked even if the temperature of the molten salt is lowered to 600° C. or less again in the electrolysis step. That is, when the separated and precipitated Na is removed by temporarily heating the molten salt at a temperature exceeding 600° C. between the reduction step and the electrolysis step, the unreacted Ca can be removed in the molten salt.

2-1. FIRST EXAMPLE

Figure 5:
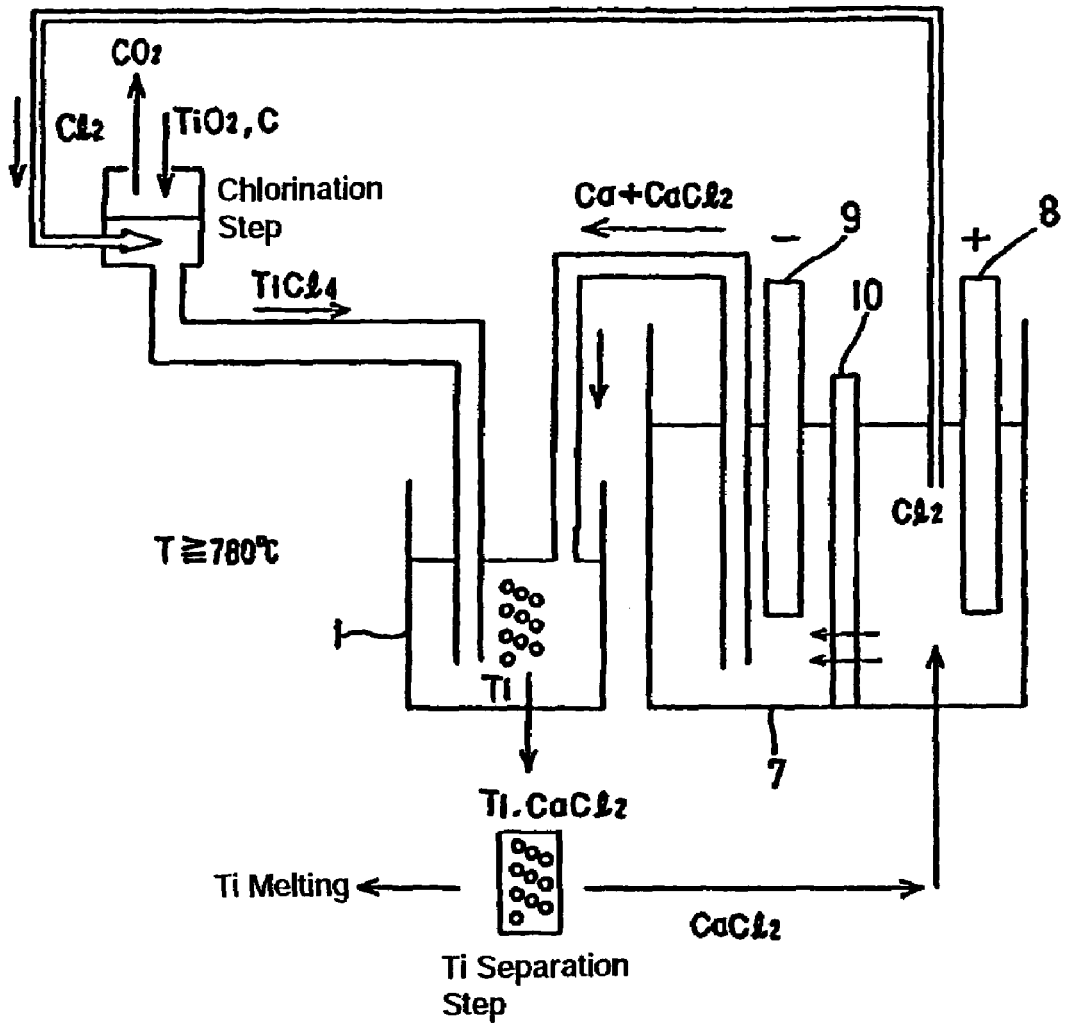
FIG. 5 is a view showing a configuration example of a metallic Ti production apparatus explaining a first example of second production method according to the present invention.

FIG. 5 is a view showing a configuration example of a metallic Ti production apparatus explaining first example of the second production method according to the present invention. The reactor vessel 1 and an electrolytic cell 7 are used in the first example. The reduction step is performed in the reactor vessel 1, and the electrolysis step is performed in the electrolytic cell 7. The reactor vessel 1 holds the molten salt which is of the supply source of Ca. The molten salt is the Ca-rich molten $CaCl_2$ in which the relatively large amount of Ca is dissolved. $CaCl_2$ has the melting point of about 780° C., and the molten salt of $CaCl_2$ is heated to the melting point or above.

In the reactor vessel 1, the gaseous $TiCl_4$ is injected into the molten salt in a dispersed manner, and $TiCl_4$ is reduced by Ca dissolved in the molten salt, which allows the particulate metallic Ti to be generated. The generated Ti particles are sequentially accumulated in the bottom portion of the reactor vessel 1 by the specific-gravity difference.

The Ti particles accumulated in the bottom portion of the reactor vessel 1 are discharged from the reactor vessel 1 along with the molten salt existing in the bottom portion of the reactor vessel 1, and the Ti particles and the molten salt are sent to the Ti separation step. In the Ti separation step, the Ti particles discharged along with the molten salt from the reactor vessel 1 are separated from the molten salt. Specifically the Ti particles are compressed to squeeze the molten salt, and the Ti particles are washed. The Ti particles obtained in the Ti separation step is melted and formed in a Ti ingot.

On the other hand, the molten salt separated from the Ti particles in the Ti separation step is the used molten salt, in which Ca is consumed and the Ca concentration is decreased. Both the molten salt and the used molten salt separately discharged from the reactor vessel 1 are sent to the electrolytic cell 7.

In the electrolytic cell 7, the molten $CaCl_2$ which is of the molten salt is electrolyzed between an anode 8 and a cathode 9, the $Cl_2$ gas is generated on the side of the anode 8, and Ca is generated on the side of the cathode 9. A separating membrane 10 which separates the side of the anode 8 and the side of the cathode 9 is provided in the electrolytic cell 7 in order to prevent the back reaction. In the back reaction, Ca generated on the cathode 9 is re-combined with the $Cl_2$ gas generated on the side of the anode 8.

The molten salt from the Ti separation step is introduced onto the side of anode 8. The separating membrane 10 is made of porous ceramics. While the separating membrane 10 permits the molten salt to flow from the side of anode 8 to the side of the cathode 9, and the separating membrane 10 suppresses movement of Ca, generated on the cathode 9, from moving toward the side of the anode 8 to prevent the back reaction.

The molten salt which becomes Ca-rich by generating and replenishing Ca on the side of cathode 9 is introduced to the reactor vessel 1, and the molten salt is circularly used for the generation of the Ti particles through the reduction by Ca. On the other hand, the $Cl_2$ gas generated on the side of the anode 8 is carried to the chlorination step. In the chlorination step, $TiCl_4$ which is of the raw material of Ti is generated by the chlorination of $TiO_2$. The generated $TiCl_4$ is introduced to the reactor vessel 1 and circularly used the generation of the Ti particles through the reduction by Ca.

Thus, in the first example, the molten salt (molten $CaCl_2$ in which Ca is dissolved) circulates the reduction step (reactor vessel 1), the separation step, and the electrolysis step (electrolytic cell 7), and Ti is continuously produced in the reduction step (reactor vessel 1) by repeating the operation in which Ca consumed in the reduction step (reactor vessel 1) is replenished in the electrolysis step (electrolytic cell 7). In other words, the high-purity Ti particles can continuously be produced through the reduction by Ca, without both the replenishment and discharge of the solid Ca, only by the operation in which the Ca concentration in the molten salt is adjusted.

In each step, the temperature of the molten salt is managed so as to be higher than the melting point (about 780° C.) of $CaCl_2$.

2-2. SECOND EXAMPLE

FIG. 5 is a view showing a configuration example of a metallic Ti production apparatus explaining second example of the second production method according to the present invention. The second example differs from the first example in that the mixture of $CaCl_2$ and NaCl is used as the molten salt. $CaCl_2$ and NaCl are mixed together at a certain ratio such that the melting point of the mixture of $CaCl_2$ and NaCl becomes 600° C. or less, thus resulting in the molten salt of the temperature of not greater than the melting point, i.e. 600° C. or less. Specifically the mixed molten salt is maintained at the temperature of 600° C. or less in the reduction step (reactor vessel 1) and the electrolysis step (electrolytic cell 7), and the mixed molten salt is maintained at the temperature exceeding 600° C. in the Ti separation step.

The low-temperature reduction and low-temperature electrolysis, in which the molten salt is maintained at the temperature of 600° C. or less, are performed in the reduction step (reactor vessel 1) and the electrolysis step (electrolytic cell 7), which enables the service life of a vessel material to be extended and enables the cost reduction of the vessel material. Further, although the molten salt is the mixture of $CaCl_2$ and NaCl, Ca emerges as the reducing agent metal (see chemical formulas (b) and (c)), the reduction reaction by Ca proceeds in the reduction step (reactor vessel 1), and the generation and replenishment of Ca proceed in the electrolysis step (electrolytic cell 7).

Because Ca is higher than Mg in reactivity, one of the important technical problems in the practical production is to develop the vessel material which can withstand Ca for a long term. The operating temperature of the molten salt is decreased by the low-temperature reduction and the low-temperature electrolysis, which reduces a load to the vessel material. Therefore, it is expected that the present invention leads to major progress to solve the above technical problem.

On the other hand, in the Ti separation step, the molten salt is discharged along with the Ti particles from the reactor vessel 1 into a separation cell 11, or the molten salt is solely discharged into the separation cell 11. In the separation cell 11, the molten salt is managed at the temperature exceeding 600° C. unlike both the reactor vessel 1 and the electrolytic cell 7. Therefore, the reducing agent metal in the molten salt is changed from the dissolved Ca (unreacted Ca) to Na (see chemical formulas (b) and (c)).

Na is not dissolved in the molten salt unlike Ca, Na floats on the molten salt, and Na is separated from the molten salt. The molten salt in which the reducing agent is removed is sent to the electrolytic cell 7, and the molten salt is managed at the temperature of 600° C. or less in the electrolytic cell 7. Since the reducing agent metal is removed in the form of Na, the re-generation of Ca never occurs. Therefore, the back reaction caused by the mixing of the unreacted Ca and the corresponding reduction of the current efficiency are prevented.

Figure 6:
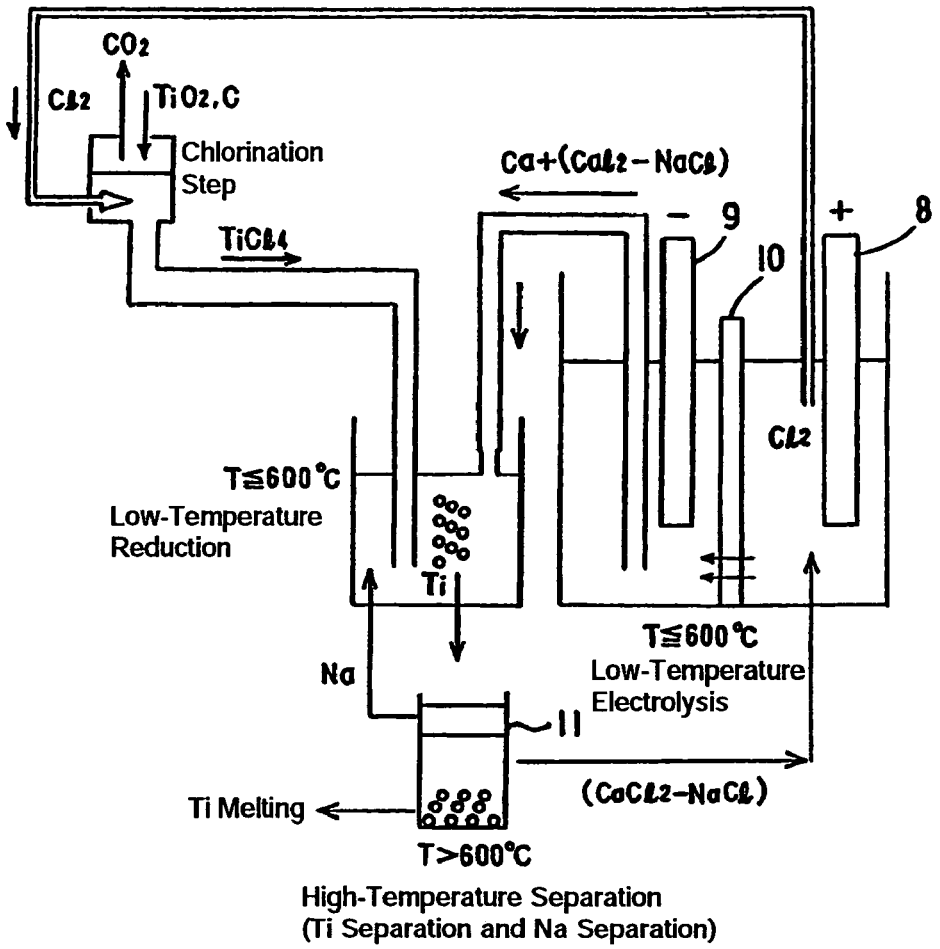
FIG. 6 is a view showing a configuration example of a metallic Ti production apparatus explaining a second example of the second production method according to the present invention.

The reducing agent metal separated in the form of Na from the molten salt is returned to the reactor vessel 1. In the reactor vessel 1, because the molten salt is cooled to 600° C. or less, Ca is replaced with Na, and Ca is replenished. The Ti separation step shown in FIG. 6 also functions as the Na separation step. In the Ti separation step, while the unreacted Ca in the molten salt sent to the electrolysis step is removed to block the invasion of Ca into the electrolysis step by changing the unreacted Ca to Na, Ca is caused to flow back to the reduction step without passing through the electrolysis step. Therefore, the reasonable and economical operation can be performed.

It is obvious that the temperature of the molten salt in the separation cell 11 can be set to 600° C. or less which is similar to the temperatures of the reactor vessel 1 and the electrolytic cell 7. This provides advantages in the durability of the vessel material, although the unreacted Ca cannot be removed.

3. Third and Fourth Production Methods

During reducing $TiCl_4$ by Ca in the method of producing Ti through the reduction by Ca, sometimes $TiCl_3$, $TiCl_2$, and the like are generated, which reduces the recovery efficiency of the metallic Ti. In the case where the molten salt is contaminated with Ti ions ($Ti^{3+}$ and $Ti^{2+}$) in association with the generation of $TiCl_3$ or $TiCl_2$, it turns out that it becomes difficult to eliminate the contamination, and thereby sometimes the generation yield of Ca is reduced to cause the difficulty in continuously producing Ti in the electrolysis step in which the molten salt whose Ca concentration is decreased is separated into Ca and $Cl_2$ by the electrolysis.

As a result of further study for solving this problem, the present inventors obtain the following new findings (1) to (4).

(1) In the case where Ca is not detected in the molten salt in the reactor vessel (namely, in the case where the Ca concentration (mass %) is 0%), the generation of $TiCl_3$, $TiCl_2$, or the like becomes remarkable in the molten salt.

(2) The generation of $TiCl_3$, $TiCl_2$, or the like depends on the temperature of the molten salt. When the temperature of the molten salt is excessively high or when the temperature of the molten salt is excessively low, the generation of $TiCl_3$, $TiCl_2$, or the like becomes remarkable, which reduces the production efficiency of Ti. The optimum temperature of the molten salt ranges from 500 to 1000° C.

(3) For a relationship between the Ca concentration of the molten salt and the temperature, $TiCl_3$, $TiCl_2$, or the like is easy to generate when the Ca concentration is low while the temperature of the molten salt is high, and the generation of $TiCl_3$, $TiCl_2$, or the like is suppressed when the Ca concentration is low while the temperature of the molten salt exists on the lower-temperature side in the optimum temperature range.

(4) The production efficiency of Ti can be enhanced when a Ca concentration C (mass %) of the molten salt and a temperature T (° C.) satisfy the following formula (1).

$$C \geqq 0.002 \times T - 1.5 \quad (1)$$

That is, in reducing $TiCl_4$ by Ca, the Ca concentration of the molten salt and the temperature of the molten salt are controlled to suppress the generation of $TiCl_3$, $TiCl_2$, or the like, which allows the production efficiency of Ti to be improved. Therefore, the amount of Ti ion ($Ti^{3+}$ and $Ti^{2+}$) transported to the electrolysis step can be decreased, so that the reduction of the generation yield of Ca can be suppressed in the electrolysis step.

3-1. Example of Third Production Method

An example of the third production method according to the present invention will be described referring to the configuration example of the metallic Ti production apparatus shown in FIG. 2. The third production method includes a "reduction step". In the reduction step, the molten $CaCl_2$ solution in which Ca is dissolved is held in the reactor vessel 1, the $TiCl_4$ gas supplied from the raw material supply pipe 6 is reacted with Ca in the molten $CaCl_2$ solution, and the Ti particles are generated in the molten $CaCl_2$ solution.

The liquid surface of the held molten $CaCl_2$ solution is set at the level higher than the molten salt discharge pipe 5 and lower than the upper end of the separation wall 4. Usually the molten $CaCl_2$ having the melting point of 780° C. is used as the molten salt. However, because it is preferable that the temperature of the molten salt be lower, the mixed salt of $CaCl_2$ and another salt can be used as the mixed salt. For example, when the mixed salt of $CaCl_2$ and NaCl is used, the melting point can be decreased to about 500° C.

In the configuration shown in FIG. 2, Ca is dissolved in $CaCl_2$ by holding the molten Ca solution on the molten $CaCl_2$ solution inside the separation wall 4. Therefore, Ca can be supplied from the Ca layer to the $CaCl_2$ layer below the Ca layer to enhance the reaction efficiency. When the $TiCl_4$ gas (bubble) reaches the Ca layer, the reduction reaction can be performed even in the molten Ca solution. Therefore, the reaction efficiency can also be enhanced from this standpoint.

In order to hold the Ca layer in molten state on the molten $CaCl_2$ solution, the temperature of the molten salt cannot be decreased to 838° C. or less. However, the melting point of the Ca layer can be decreased by mixing other alkali-earth metals or alkali metals with Ca. For example, the melting point can be decreased to 516° C. by mixing Ca and Mg. Only Ca is dissolved into the molten salt from the mixture of Ca and Mg, and Mg is hardly dissolved. In the separation wall 4, while Ca is replenished by dissolving Ca into the molten $CaCl_2$ solution from the molten Ca solution held on the molten $CaCl_2$ solution, Ca is replenished to the molten $CaCl_2$ solution inside the separation wall 4 through the reducing agent supply pipe 2.

Thus, the $TiCl_4$ gas is reacted with Ca in the molten salt by supplying the $TiCl_4$ gas from the raw material supply pipe 6 into the molten $CaCl_2$ solution held in the reactor vessel 1. This enables $TiCl_4$ to be reduced to generate the particulate metallic Ti in the molten $CaCl_2$ solution inside the separation wall 4.

In this example, $TiCl_4$ is supplied by directly blowing the gaseous $TiCl_4$ into the molten $CaCl_2$ solution. Because the blown $TiCl_4$ gas goes up through the molten $CaCl_2$ solution while formed in many fine bubbles, the $TiCl_4$ gas has the high contact efficiency with the molten $CaCl_2$ solution, and the stirring of the molten $CaCl_2$ solution is promoted. Therefore, the high reaction efficiency is obtained. Further, the reaction can be performed in the wider region.

The third production method includes a "separation step" subsequent to the reduction step. In the separation step, the Ti particles generated in the molten $CaCl_2$ solution are separated from the molten $CaCl_2$ solution. Alternatively, the separation of the Ti particles generated in the molten $CaCl_2$ solution from the molten $CaCl_2$ solution may be performed in the reactor vessel. However, in this case, the operation is performed in a batch manner. In order to enable the continuous production and to improve the productivity, it is preferable that the generated Ti and the molten $CaCl_2$ solution be separated outside the reactor vessel after the generated Ti is discharged outside the reactor vessel along with the molten $CaCl_2$ solution. The Ti is generated in the particulate form, so that the generated Ti and the molten $CaCl_2$ solution can easily be separated from each other by a mechanical separation method.

The Ti particles accumulated in the bottom portion of the reactor vessel 1 are discharged along with the molten $CaCl_2$ solution through the Ti discharge pipe 3, and the Ti particles are sent to the separation step. In the separation step, the Ti particles discharged along with the molten $CaCl_2$ solution are separated from the molten $CaCl_2$ solution. For example, a method, in which the molten $CaCl_2$ solution containing the Ti particles is introduced to a circular cylinder with hole and the Ti particles are packed by compressing the Ti particles to squeeze the molten $CaCl_2$ solution, can be used. The separated molten $CaCl_2$ solution is sent to the electrolysis step.

In the third production method, when $TiCl_4$ is reduced by Ca, the reduction reaction is performed under the conditions that the Ca concentration C (mass %) of the molten salt (in this case, molten $CaCl_2$ solution) in the reactor vessel 1 is C>0 mass % and the temperature of the molten salt ranges from 500 to 1000° C.

Because sometimes $TiCl_3$, $TiCl_2$, or the like is generated in the procedure in which the reduction reaction of $TiCl_4$ by Ca proceeds, the reduction reaction is performed under the above conditions to prevent the generation of $TiCl_3$, $TiCl_2$, or the like, which suppresses the reduction of the recovery efficiency of Ti. Further, when $TiCl_3$ or $TiCl_2$ is dissolved in the molten $CaCl_2$ solution, Ti is precipitated on the electrode in the later-mentioned electrolysis step, and an anode reaction in which $Ti^{2+}$ is oxidized to $Ti^{3+}$ and a cathode reaction which is the reverse of the anode reaction occur, which results in the problem that the production yield of Ca is reduced. The reduction reaction is also performed under the above conditions in order to suppress the reduction of the production yield of Ca.

For the above conditions, the reason why the Ca concentration C (mass %) of the molten salt in the reactor vessel 1 is C>0 mass % is as follows. That is, when the temperature of the molten salt is lower than about 800° C., because a reaction rate at which $TiCl_3$, $TiCl_2$, or the like is generated is also reduced, even if the Ca concentration is low, the reduction reaction of $TiCl_4$ to Ti is generated as long as Ca exists, namely, as long as the Ca concentration C is C>0 mass %.

The reason why the lower-limit temperature of the molten salt is set to 500° C. is that the melting point can be decreased to about 500° C. at the minimum, e.g., in the mixed salt of $CaCl_2$ and NaCl. The reason why the upper-limit temperature of the molten salt is set to 1000° C. is as follows. That is, although the reaction rate can be enhance to achieve the improvement of the production efficiency of Ti when the temperature of the molten salt is increased as much as possible, the selection of the material which can be used as the reactor vessel becomes extremely difficult when the upper-limit temperature exceeds 1000° C.

Figure 7:
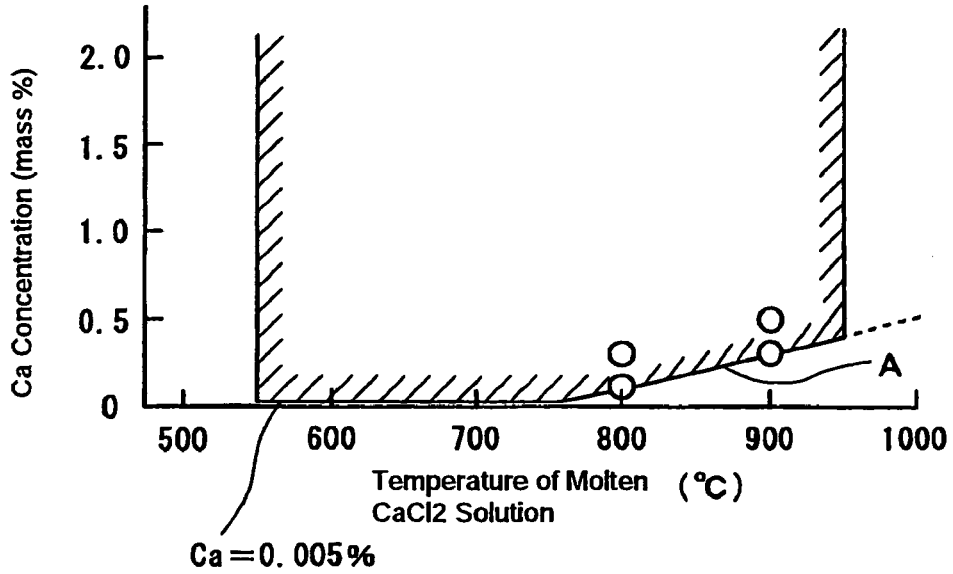
FIG. 7 is a view showing a relationship between a Ca concentration and a molten $CaCl_2$ solution temperature when $TiCl_4$ is reduced by Ca in the molten $CaCl_2$ solution.

FIG. 7 is a view showing a relationship between the Ca concentration and the molten $CaCl_2$ solution temperature when $TiCl_4$ is reduced by Ca in the molten $CaCl_2$ solution. According to the relationship shown in FIG. 7, because the reduction of the production efficiency of Ti in the reduction step and the reduction of the production yield of Ca in the electrolysis step can be suppressed more effectively, it is preferable that the reduction reaction be performed under the conditions that the Ca concentration C (mass %) of the molten $CaCl_2$ solution is $C \geqq 0.005$ mass %, the temperature of the molten salt ranges from 550 to 950° C., and the relationship between the Ca concentration and the temperature satisfies the following formula (1). Where, in the formula (1), T is a temperature (° C.) of the molten salt in the reactor vessel.

$$C \geqq 0.002 \times T - 1.5 \quad (1)$$

In the reactor vessel having the configuration shown in FIG. 2, a constant amount of $TiCl_4$ gas is supplied while the temperature of the molten $CaCl_2$ solution is maintained at 800° C. or 900° C., the Ca concentration of the molten $CaCl_2$ solution is variously changed to perform the reduction reaction of $TiCl_4$ by Ca, and FIG. 7 is obtained by investigating presence or absence of the generation of $TiCl_3$ and $TiCl_2$.

The area shown by hatching in FIG. 7 is the preferable conditions. Although the temperature of the molten salt can be decreased to about 500° C. as described above, it is practically thought that the lower limit becomes about 550° C. When the temperature of the molten salt exceeds 950° C., the selection of the material which can be used as the reactor vessel becomes difficult. Accordingly, the preferable temperature of the molten salt is set in range of 550 to 950° C.

That relationship between the Ca concentration and the temperature is defined by the formula (1) is determined by the investigation result based on experiments. In FIG. 7, the symbol of O indicates an actual measurement value. In the lower-right portion of the area shown by hatching of FIG. 7, the line (indicated by the sign A in the range of 800 to 950° C.) sloped upward from left to right corresponds to the lower limit of the range shown by the formula (1).

Considering the reaction generated in FIG. 7, the reaction of the following chemical formula (f) occurs to generate the metallic Ti because Ca necessary to the reduction of $TiCl_4$ is sufficiently supplied for the range from above the line A sloped upward from left to right and an extended line (shown by a broken line in FIG. 7) (high-Ca concentration area). However, for the range from below the line A sloped upward from left to right and the extended line (low-Ca concentration area), it is thought that the reaction of the following chemical formula (g) occurs simultaneously and Ti generated by the reduction is oxidized again to generate $TiCl_4$.

$$TiCl_4+2Ca \rightarrow Ti+CaCl_2 \quad (f)$$

$$TiCl_4+Ti \rightarrow 2TiCl_2 \quad (g)$$

In the low-Ca concentration area where a bath temperature is not more than 800° C., it is speculated that sometimes $TiCl_2$ is generated by the reaction of the following chemical formula (h) because of a small absolute amount of Ca.

$$TiCl_4+Ca \rightarrow TiCl_2+CaCl_2 \quad (h)$$

For the reactions of (g) and (h), Ti is finally generated by the following chemical formula (i) under the condition that the Ca concentration C (mass %) is C>0 mass %.

$$TiCl_2+Ca \rightarrow Ti+CaCl_2 \quad (i)$$

3-2. Examples of Fourth Production Method

An example of the fourth production method according to the present invention will be described referring to the configuration example of the metallic Ti production apparatus shown in FIG. 2. When compared with the third production method, the fourth production method includes the electrolysis step of enhancing the Ca concentration by electrolyzing the molten salt in which the Ca concentration is decreased according to the generation of the Ti particles, and that the molten salt having the increased Ca concentration which is generated in the electrolysis step is used for the reduction of $TiCl_4$ in the reduction step is added to the fourth production method.

As described above, when the reduction reaction proceeds in the molten $CaCl_2$ solution in the reactor vessel, Ca is consumed in the molten $CaCl_2$ solution to generate Ti, and $CaCl_2$ is simultaneously generated as the by-product. $CaCl_2$ which is also generated as the by-product when Ti is generated in the molten Ca solution held on the molten $CaCl_2$ solution. Therefore, the Ca concentration is decreased in the molten $CaCl_2$ solution to block the efficient progress of the reaction.

In the fourth production method, $CaCl_2$ which is generated as the by-product in association with the progress of the reaction is discharged outside the reactor vessel. Specifically, the molten $CaCl_2$ solution containing $CaCl_2$ which is generated as the by-product in association with the progress of the reaction by the reduction reaction inside the separation wall 4 in the reactor vessel 1 comes up in the outside of the separation wall 4 through the lower portion of the separation wall 4, the molten $CaCl_2$ solution containing $CaCl_2$ is discharged from the molten salt discharge pipe 5, and the molten $CaCl_2$ solution containing $CaCl_2$ is sent to the electrolysis step.

Therefore, the fourth production method is provided with the step of electrolyzing the molten salt in which the Ca concentration is decreased, so that there is no fear about the decrease in Ca concentration, the blocking of the progress of the reaction, or the like, by $CaCl_2$ which is of the by-product. In the fourth production method, the molten salt used for the electrolysis may be either the molten salt discharged from the molten salt discharge pipe 5, or the molten salt in which the generated Ti is discharged along with the molten $CaCl_2$ solution to separate Ti in the separation step. Of course, both molten salts as above can be used. It is also possible that the electrolysis step is performed to the molten salt ($CaCl_2$) in the reactor vessel without discharging the molten salt ($CaCl_2$) outside the reactor vessel.

The "electrolysis step" is one in which the Ca concentration is increased by electrolyzing the molten salt whose Ca concentration is decreased according to the generation of the Ti particles. The molten salt having the increased Ca concentration, which is generated in the electrolysis step, is used for the reduction of $TiCl_4$ in the reduction step.

The electrolysis step will be described referring to the apparatus configuration shown in FIG. 2. The molten $CaCl_2$ solution sent from the reactor vessel 1 through the molten salt discharge pipe 5 and the molten $CaCl_2$ solution sent from the separation step is separated into Ca and $Cl_2$ gas by the electrolysis, and Ca is returned into the reactor vessel 1 through the reducing agent supply pipe 2. In this case, it is not necessary that Ca be completely separated from $CaCl_2$, and Ca may be returned along with $CaCl_2$. This is because the molten $CaCl_2$ solution in which Ca is dissolved is used in the reactor vessel 1.

Since the fourth production method is provided with the electrolysis step, $CaCl_2$ can be electrolyzed into Ca and $Cl_2$ to use the generated Ca for the generation reaction of Ti in the reactor vessel. In this case, as described above, a method for temporarily discharging $CaCl_2$ outside the reactor vessel to electrolyze $CaCl_2$ can also be adopted. Further, $CaCl_2$ is not discharged outside the reactor vessel, for example, the reactor vessel and the electrolytic cell are integrated with each other to impart the function of the electrolytic cell to the reactor vessel, and the $CaCl_2$ which is of the by-product can be electrolyzed in the reactor vessel.

That is, since the fourth production method includes the electrolysis step in which the Ca concentration is increased by electrolyzing the molten salt whose Ca concentration is decreased, the fourth production method forms the cycle in which the reduction step, the separation step, and the electrolysis step cooperate with one another, and Ca which is of the reducing agent of $TiCl_4$ can be circulated to continuously produce Ti through the reduction by Ca.

The fourth production method can also adopt an example which includes the chlorination step to use $TiCl_4$, generated in the chlorination step, for the generation reaction of Ti in the reactor vessel. In the chlorination step, $TiCl_4$ is generated by reacting $Cl_2$, generated in the electrolysis step, with $TiO_2$.

The apparatus configuration shown in FIG. 2 is configured to be able to adopt the above example. That is, the $Cl_2$ gas generated in the electrolysis step is sent to the chlorination step, carbon (C) is added to react $TiO_2$ with $Cl_2$ at a high temperature, and $TiO_2$ is chlorinated. The produced $TiCl_4$ is introduced into the reactor vessel 1 through the raw material supply pipe 6, and $TiCl_4$ is used for the generation reaction of Ti. Since carbon (C) is added, $CO_2$ is formed as the by-product.

The chlorination step is incorporated into the fourth production method. Therefore, Ca which is of the reducing agent and the $Cl_2$ gas necessary for the chlorination are circulated by re-utilizing $CaCl_2$ which is formed as the by-product by the reduction of $TiCl_4$, so that the metallic Ti can continuously be produced only by replenishing $TiO_2$ and carbon (C).

Even in the fourth production method, when $TiCl_4$ is reduced by Ca, it is necessary that the reduction reaction be performed under the conditions that the Ca concentration C (mass %) of the molten salt in the reactor vessel 1 is C>0 mass % and the temperature of the molten salt ranges from 500 to 1000° C.

The setting of the above conditions enables the generation of $TiCl_3$, $TiCl_2$, or the like to be prevented in the procedure in which the reduction reaction proceeds, or enables the promotion of the reaction in which the generated $TiCl_3$ or $TiCl_2$ is rapidly reacted with the remaining Ca to form Ti. Therefore, the recovery efficiency of Ti is improved and the reduction of the production yield of Ca is suppressed in the electrolysis step.

Further, as shown in FIG. 7, the reduction of the production efficiency of Ti in the reduction step and the reduction of the production yield of Ca in the electrolysis step can be suppressed more effectively when the conditions are set as follows. That is, the reduction reaction be performed under the conditions that the Ca concentration C (mass %) of the molten $CaCl_2$ solution is $C \geqq 0.005$ mass %, the temperature of the molten salt ranges from 550 to 950° C., and the relationship between the Ca concentration and the temperature satisfies the following formula (1).

$$C \geqq 0.002 \times T - 1.5 \quad (1)$$

INDUSTRIAL APPLICABILITY

The method for producing Ti or the Ti alloy through the reduction by Ca according to the present invention is a method for reducing $TiCl_4$, which can produce the high-purity metallic Ti or the high-purity Ti alloy. Ca is used as the reducing agent, particularly the molten salt containing $CaCl_2$ and having Ca dissolved therein is held in the reactor vessel, and the metallic chloride containing $TiCl_4$ is reacted with Ca in the molten salt to generate the Ti particles or the Ti alloy particles in the molten $CaCl_2$ solution, which allows the enhancement of the feed rate of $TiCl_4$ which is of the raw material of Ti, and also allows the continuous operation. Therefore, the high-purity metallic Ti or the high-purity Ti alloy can economically be produced with high efficiency. Further, the method by the present invention eliminates the need of the replenishment of expensive metallic Ca and of the operation for separately handling Ca which is highly reactive and difficult to handle. Accordingly, the method by the present invention can widely be applied as the industrial method for producing Ti or the Ti alloy.

The invention claimed is:

1. A method for producing Ti or a Ti alloy through reduction by Ca, the method comprising:

holding a molten salt in a reactor vessel, said molten salt containing $CaCl_2$, Ca being dissolved in said molten salt, and reacting a metallic chloride containing $TiCl_4$ with Ca in the molten salt by introducing the metallic chloride into the molten salt to generate Ti particles or Ti alloy particles in said molten salt;

separating the Ti particles or Ti alloy particles, generated in said molten salt, from said molten salt to leave a remaining molten salt containing $CaCl_2$ that is discharged outside the reactor vessel;

electrolyzing the remaining molten salt containing $CaCl_2$ to generate an electrolyzing step output of a molten salt with a concentration of Ca increased with respect to the remaining molten salt; and returning the increased Ca concentration molten salt generated by said electrolysis step to the reactor vessel for the reacting step so as to be used for the generation reaction of Ti or the Ti alloy in the reactor vessel.

2. A method for producing Ti or a Ti alloy through reduction by Ca according to claim 1, wherein said molten salt containing $CaCl_2$ is a molten salt containing $CaCl_2$ and NaCl.

3. A method for producing Ti or a Ti alloy through a reduction reaction by Ca according to claim 1, wherein wherein said molten salt containing $CaCl_2$ with Ca being dissolved in said molten salt is circulated in the reactor vessel.

4. A method for producing Ti or a Ti alloy through reduction by Ca according to claim 1, wherein, in said introducing step, Ca generated by the electrolysis is dissolved in the molten salt and introduced into said reactor vessel, Ca being generated by said electrolysis.

5. A method for producing Ti or a Ti alloy through reduction by Ca according to claim 1, comprising a chlorination step of reacting $Cl_2$ with $TiO_2$ to generate $TiCl_4$, $Cl_2$ being of a by-product in said electrolysis step, wherein $TiCl_4$ generated in the chlorination step is used for the generation reaction of Ti or the Ti alloy in the reactor vessel.

6. A method for producing Ti or a Ti alloy through reduction by Ca according to claim 3, wherein said molten salt is a mixed molten salt containing $CaCl_2$ and NaCl.

7. A method for producing Ti or a Ti alloy through reduction by Ca according to claim 6, wherein said mixed molten salt contains $CaCl_2$ and NaCl with a mixed ratio so that the melting point becomes 600° C. or lower, and said mixed molten salt is maintained at the temperature of not less than the melting point and not higher than 600° C. in at least said reduction step.

8. A method for producing Ti or a Ti alloy through reduction by Ca according to claim 7, comprising a Na separation step of generating Na, while the molten salt discharged from said reactor vessel is maintained at a temperature of higher than 600° C. before the molten salt is supplied to said electrolysis step, and of separating and removing Na thus generated.

9. A method for producing Ti or a Ti alloy through reduction by Ca according to claim 1, wherein said metallic chloride containing $TiCl_4$ is a mixture containing $TiCl_4$ and other metallic chloride.

10. A method for producing Ti or a Ti alloy through reduction by Ca according to claim 1, further comprising holding the increased Ca concentration molten salt on the molten salt in the reactor vessel such that Ca is supplied from said increased Ca concentration molten salt to said molten salt located beneath said increased Ca concentration molten salt.

11. A method for producing Ti through reduction by Ca according to claim 1, wherein a Ca concentration C (mass %) of the molten salt in said reactor vessel is $C>0$ mass % and a temperature of the molten salt ranges from 500 to 1000° C.

12. A method for producing Ti through reduction by Ca according to claim 11, comprising a chlorination step of reacting $Cl_2$ with $TiO_2$ to generate $TiCl_4$, $Cl_2$ being generated in the electrolysis step, wherein $TiCl_4$ generated in the chlorination step is used for the generation reaction of Ti in the reactor vessel.

* * * * *